US008498552B2

(12) United States Patent
Kamimura

(10) Patent No.: US 8,498,552 B2
(45) **Date of Patent: *Jul. 30, 2013**

(54) IMAGE FORMING DEVICE INCLUDING MOVABLE SUPPORT MEMBER AND TONER CARTRIDGE HAVING MOVABLE SHUTTER

(75) Inventor: Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 181 days.

This patent is subject to a terminal disclaimer.

(21) Appl. No.: 13/044,518

(22) Filed: Mar. 9, 2011

(65) Prior Publication Data

US 2011/0299878 A1 Dec. 8, 2011

(30) Foreign Application Priority Data

Jun. 7, 2010 (JP) ..... 2010-130187

(51) Int. Cl.
*G03G 15/00* (2006.01)

(52) U.S. Cl.
USPC ..... 399/110; 399/106; 399/120; 399/262

(58) Field of Classification Search
USPC ..... 399/110, 120, 106, 258, 262
See application file for complete search history.

(56) References Cited

U.S. PATENT DOCUMENTS

| | | | |
|---|---|---|---|
| 5,612,769 | A | 3/1997 | Sugihara et al. |
| 5,768,662 | A | 6/1998 | Sugihara et al. |
| 2006/0067734 | A1 | 3/2006 | Igarashi et al. |
| 2009/0129823 | A1 | 5/2009 | Koshimori et al. |
| 2009/0142079 | A1 | 6/2009 | Sato et al. |
| 2009/0169267 | A1 | 7/2009 | Sakuma |
| 2010/0080615 | A1 | 4/2010 | Kikuchi |
| 2012/0003000 | A1 * | 1/2012 | Nishiyama et al. ..... 399/110 |

FOREIGN PATENT DOCUMENTS

| | | | |
|---|---|---|---|
| JP | H07-152239 | A | 6/1995 |
| JP | 2005-165180 | A | 6/2005 |
| JP | 2006-098772 | A | 4/2006 |
| JP | 2006-259343 | A | 9/2006 |
| JP | 2006-298553 | A | 11/2006 |
| JP | 2006-309016 | A | 11/2006 |
| JP | 2009-122543 | A | 6/2009 |
| JP | 2009-139489 | A | 6/2009 |
| JP | 2009-157204 | A | 7/2009 |
| JP | 2010-102350 | A | 5/2010 |

OTHER PUBLICATIONS

Japan Patent Office, Decision to Grant for Japanese Patent Application No. 2010-130187 (counterpart to above-captioned patent application), mailed May 1, 2012.

* cited by examiner

*Primary Examiner* — David Gray
*Assistant Examiner* — Laura Roth
(74) *Attorney, Agent, or Firm* — Baker Botts L.L.P.

(57) ABSTRACT

An image forming device includes a support member and a plurality of operation members supported on the support member. The support member is movable relative to a main casing. A plurality of toner cartridges is detachably mounted on the support member, and each includes a casing formed with an opening for supplying toner to a corresponding developing unit and a shutter movable relative to the casing to selectively open and close the opening. Each operation member is operated in a direction substantially parallel to an axial direction of photosensitive drums to press one of the casing and the shutter, thereby moving the shutter relative to the casing in the direction to open the opening.

6 Claims, 13 Drawing Sheets

IMAGE FORMING DEVICE INCLUDING MOVABLE SUPPORT MEMBER AND TONER CARTRIDGE HAVING MOVABLE SHUTTER

CROSS REFERENCE TO RELATED APPLICATION

This application claims priority from Japanese Patent Application No. 2010-130187 filed Jun. 7, 2010. The entire content of this priority application is incorporated herein by reference.

TECHNICAL FIELD

The present invention relates to an image forming device, such as a laser printer.

BACKGROUND

There has been provided a tandem color printer having four photosensitive drums that can be integrally detached from a main casing and that correspond to each of four colors yellow, magenta, cyan, and black.

This type of color printer is provided with a drawer frame that can be pulled out of the main casing. The drawer frame supports the four photosensitive drums juxtaposed in a direction parallel to a pull-out direction of the drawer frame. The drawer frame is formed with four cartridge attachment sections corresponding to the photosensitive drums. A developing frame having a developing roller is attached to each cartridge attachment section. When the developing frame runs out of toner, then the developing frame is detached from the drawer frame and replaced with a new one.

Laser printer manufactures and the like are recently urged to meet demand for cost reductions and environmental concerns. In terms of cost reductions and environmental concerns, it is undesirable to replace the entire developing frame that has the developing roller when toner runs out, but it is desirable to replace only a toner cartridge for accommodating toner without replacing the developing frame.

Thus, there has been proposed a toner cartridge that is detachable from the developing frame such that only the toner cartridge can be replaced. The toner cartridge is formed with an opening for supplying toner from the toner cartridge into the developing frame. The toner cartridge is also provided with a shutter for selectively opening and closing the opening so as to prevent toner leakage from the toner cartridge detached from the developing frame.

SUMMARY

In the conventional configuration, a user needs to manually open the shutter after a new toner cartridge is attached to the developing frame. Because the user needs to manually open the shutter when the drawer frame is located at a pulled-out position outside the main casing, there is a danger that the color printer overturns if a downward force is applied to the drawer frame at this time.

In view of the foregoing, it is an object of the invention to provide an image forming device capable of reliably preventing overturn at the time of opening a shutter.

In order to attain the above and other objects, the invention provides an image forming device including a main casing, a support member movable relative to the main casing between an accommodated position within the main casing and a pulled-out position outside the main casing, a plurality of photosensitive drums supported on the support member and aligned in a line at intervals, a plurality of developing units corresponding to the plurality of photosensitive drums and supported on the support member, a plurality of toner cartridges corresponding to the plurality of developing units and detachably mounted on the support member, and a plurality of operation members corresponding to the plurality of toner cartridges and supported on the support member. Each of the toner cartridges includes a casing formed with an opening for supplying toner accommodated in the casing to the corresponding one of the developing units and a shutter movable relative to the casing to selectively open and close the opening. Each of the operation members is operated in a first direction substantially parallel to an axial direction of the photosensitive drums to press one of the casing and the shutter, thereby moving the shutter relative to the casing in the first direction to open the opening.

BRIEF DESCRIPTION OF THE DRAWINGS

The particular features and advantages of the invention as well as other objects will become apparent from the following description taken in connection with the accompanying drawings, in which.

DETAILED DESCRIPTION

A color printer 1 as an image forming device according to an embodiment of the invention will be described while referring to the accompanying drawings.

Figure 1:
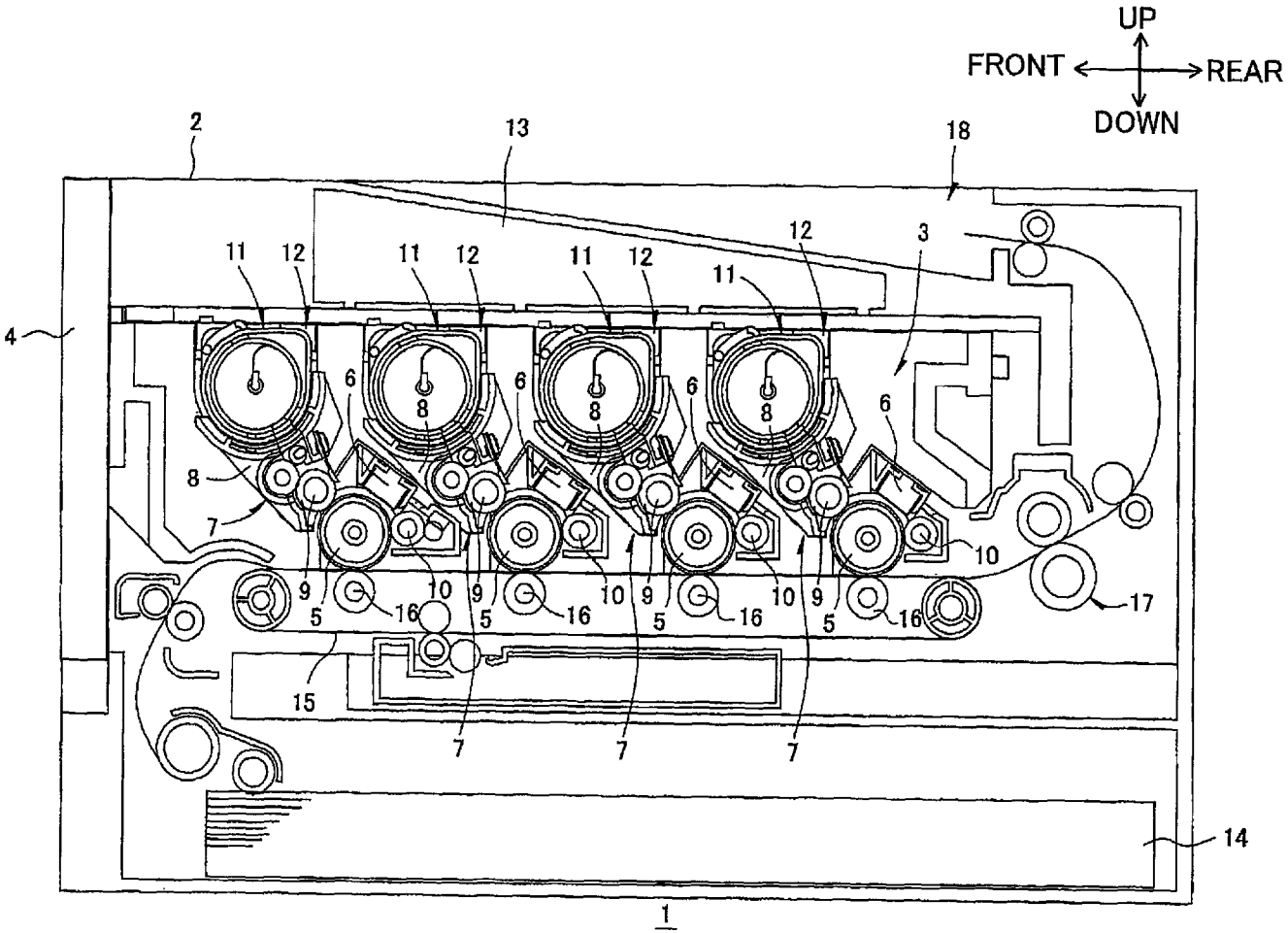
FIG. 1 is a cross-sectional right side view of a color printer according to a first embodiment of the invention.
Figure 2:
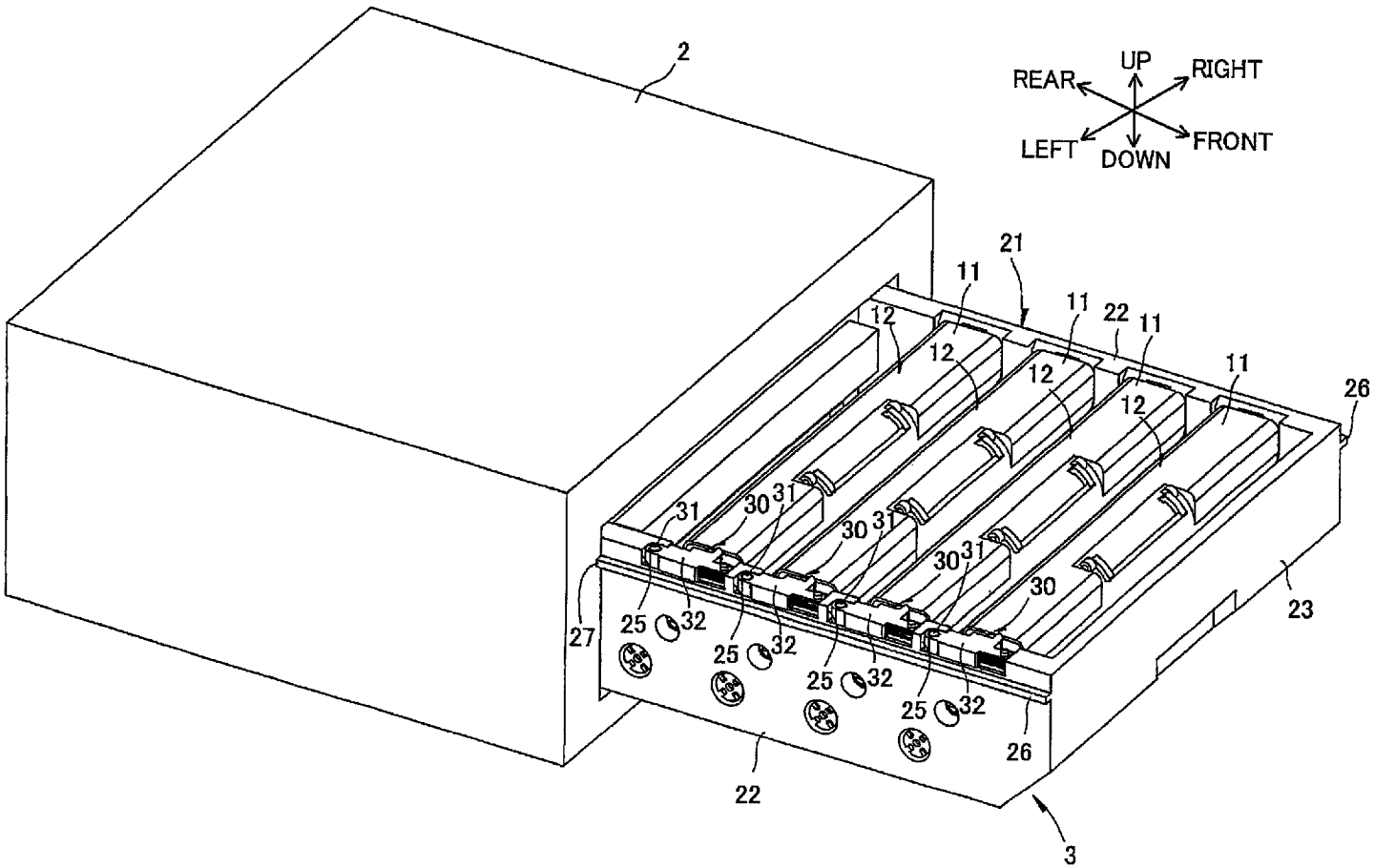
FIG. 2 is a perspective view of the color printer of FIG. 1, with a drawer unit being located at a pulled-out position outside a main casing.
Figure 3:
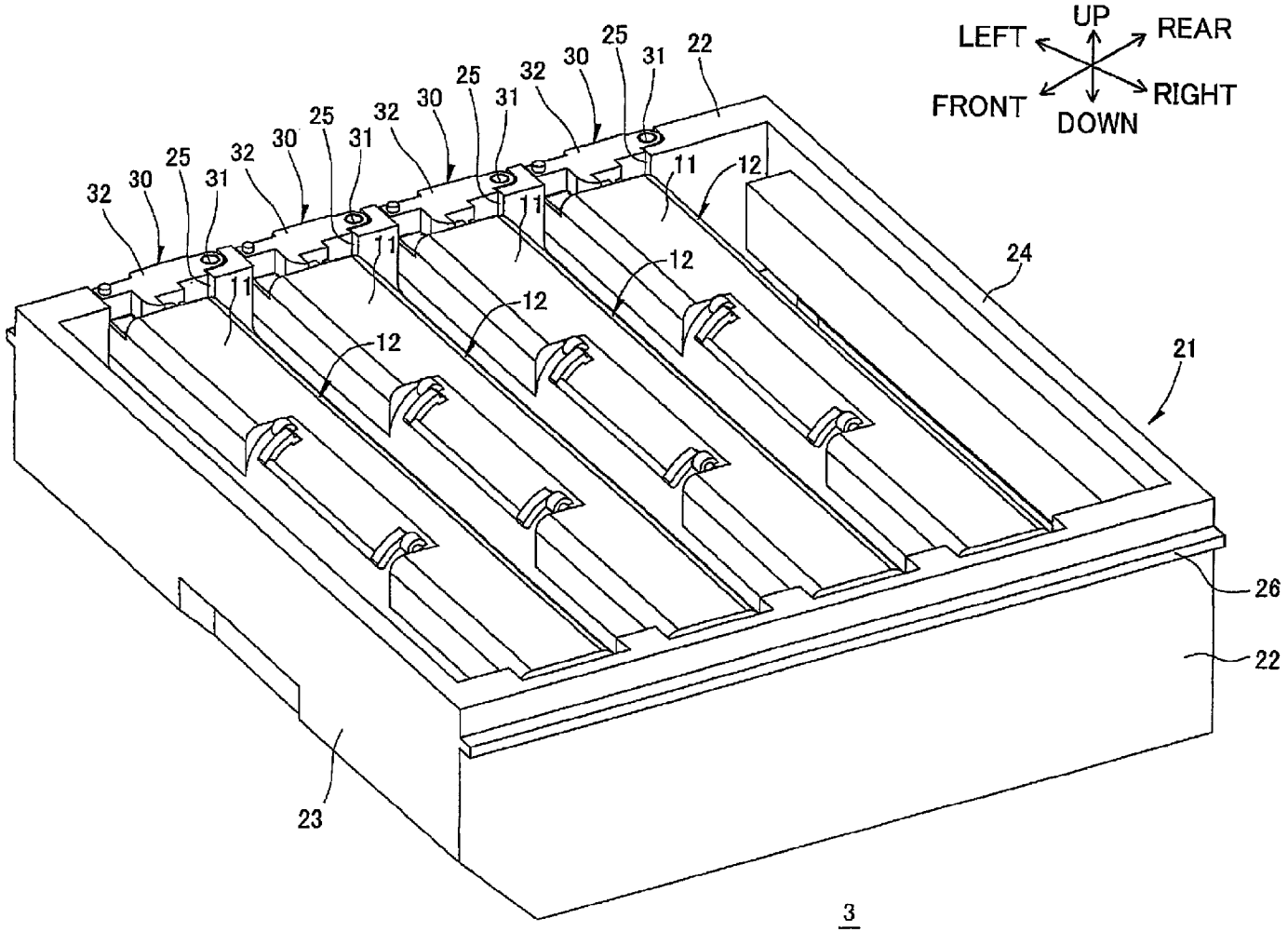
FIG. 3 is a perspective view of the drawer unit from a point diagonally above and frontward thereof.
Figure 4:
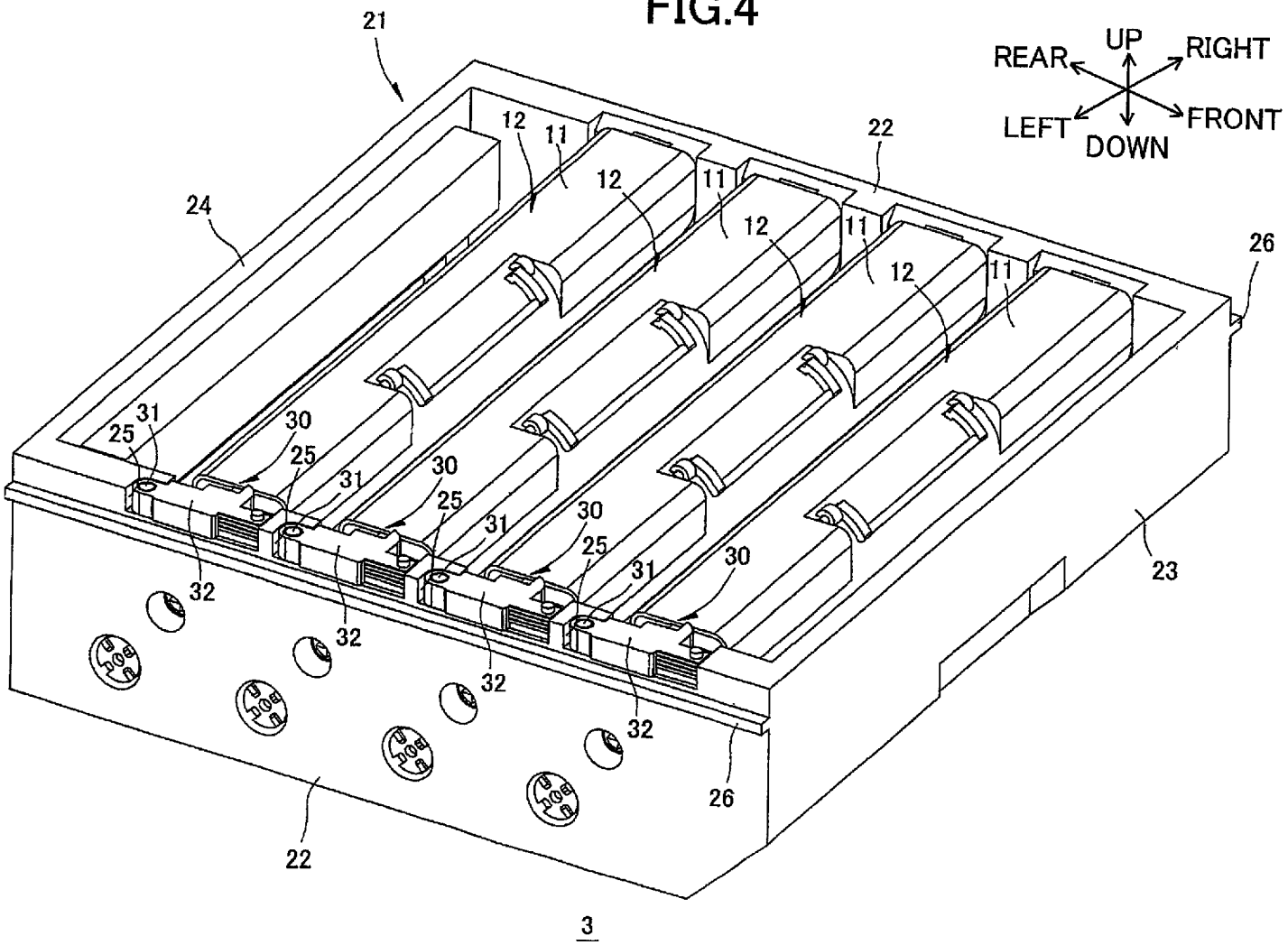
FIG. 4 is a perspective view of the drawer unit from a point diagonally above and leftward thereof.

As shown in FIG. 1, the color printer 1 is a tandem type color printer. As shown in FIGS. 1 and 2, the color printer 1 includes a main casing 2 that accommodates a drawer unit 3. The main casing 2 is formed with a front cover 4 that can be selectively opened and closed. The drawer unit 3 can move in a front-rear direction (horizontal direction) relative to the main casing 2 between an accommodated position (FIG. 1) within the main casing 2 and a pulled-out position (FIG. 2) outside the main casing 2, when the front cover 4 is open.

Note that the terms "upward," "downward," "upper," "lower," "above," "below," "right," "left," "front," "rear" and the like will be used throughout the description assuming that the color printer 1 is disposed in an orientation in which it is intended to be used and that the drawer unit 3 and toner cartridges 11 (described later) mounted thereon are accommodated in the main casing 2, unless defined otherwise. In use, the color printer 1 is disposed as shown in FIG. 1. The left and right sides of the main casing 2 will be based on the perspective of a user looking at the color printer 1 from the front side.

The color printer 1 also includes four photosensitive drums 5, four chargers 6 in one-to-one correspondence with the photosensitive drums 5, four developing units 7 in one-to-one correspondence with the photosensitive drums 5, and four cleaners 10 in one-to-one correspondence with the photosensitive drums 5.

The drawer unit 3 supports the four photosensitive drums 5 such that the photosensitive drums 5 can rotate about respective rotary shafts extending along a right-left direction. The four photosensitive drums 5 are provided for respective colors black (K), yellow (Y), magenta (M), and cyan (C), and are aligned at fixed intervals in the front-rear direction. The order of the photosensitive drums 5 arranged from front to rear in this embodiment are for black, yellow, magenta, and cyan.

The drawer unit 3 also supports the four chargers 6, the four developing units 7, and the four cleaners 10. The chargers 6 are disposed diagonally rearward and upward of the respective photosensitive drums 5. Each charger 6 is a Scorotron charger including a wire and a grid. The developing units 7 are disposed diagonally frontward and upward of the respective photosensitive drums 5. Each developing unit 7 includes a developing frame 8 and a developing roller 9 accommodated in the developing frame 8. The developing roller 9 is disposed rotatable about a rotary shaft extending along the right-left direction and is in contact with the corresponding photosensitive drum 5.

Each cleaner 10 is located rearward of the corresponding photosensitive drum 5 for removing paper dust and the like from the surface of the photosensitive drum 5.

In the drawer unit 3, four spaces 12 are defined at positions above the developing units 7 for accommodating the respective toner cartridges 11. The toner cartridges 11 are accommodated into the corresponding spaces 12 from above when the drawer unit 3 is at the pulled-out position. The toner cartridge 11 accommodates toner therein and supplies the toner to the corresponding developing unit 7.

The color printer 1 also includes an exposing unit 13 accommodated in the main casing 2 at a position above the drawer unit 3. The exposing unit 13 irradiates four laser beams corresponding to each color.

A surface of each photosensitive drum 5 is uniformly charged by a discharge from the corresponding charger 6 as the photosensitive drum 5 rotates, and is then selectively exposed to the laser beam from the exposing unit 13. As a result, an electric potential on the surface of the photosensitive drum 5 is selectively lowered, thereby forming an electrostatic latent image on the surface of the photosensitive drum 5. When the electrostatic latent image is brought into confrontation with the corresponding developing roller 9, toner is selectively supplied onto the electrostatic latent image. As a result, a toner image is formed on the surface of the photosensitive drum 5.

Note that the color printer 1 may include four LED arrays, instead of the exposing unit 13.

The color printer 1 further includes a sheet supply cassette 14, a convey belt 15, four transfer rollers 16, and a fixing unit 17. The sheet supply cassette 14 is for accommodating paper sheets P and disposed in the bottom of the main casing 2. The paper sheets P accommodated in the sheet supply cassette 14 are conveyed one at a time onto the convey belt 15 by various rollers. The convey belt 15 is disposed below and opposite to the four photosensitive drums 5. The transfer rollers 16 are disposed in confrontation with the respective photosensitive drums 5 with an upper section of the convey belt 15 interposed therebetween. The paper sheet P conveyed onto the convey belt 15 is conveyed rearward by rotation of the convey belt 15 to pass through positions between the convey belt 15 and each photosensitive drum 5 in sequence. The toner image formed on the surface of each photosensitive drum 5 is transferred onto the paper sheet P when brought into confrontation therewith.

The fixing unit 17 is disposed on a downstream side of the convey belt 15 with respect to a sheet convey direction in which the paper sheet P is conveyed. The paper sheet P with toner images transferred thereon is conveyed to the fixing unit 17. The fixing unit 17 fixes the toner images onto the paper sheet P by heat and pressure. The paper sheet P with the toner images fixed thereon is discharged by various rollers onto a discharge tray 18 formed on an upper surface of the main casing 2.

As shown in FIGS. 2 to 6, the drawer unit 3 includes a drawer frame (support member) 21. The drawer frame 21 includes a pair of left and right side plates 22 disposed in confrontation with each other with a gap defined therebetween in the right-left direction, a front beam 23 spanning between front ends of the side plates 22, and a rear beam 24 spanning between rear ends of the side plates 22, and is formed in a rectangular frame shape as a whole in a plan view.

The four photosensitive drums 5, the four chargers 6, the four developing units 7, and the four cleaners 10 (FIG. 1) are all supported by and sandwiched between the side plates 22 on the left and right sides. The spaces 12 are defined between the side plates 22 at positions above the developing units 7. In other words, the side plates 22 support the four photosensitive drums 5, the four chargers 6, the four developing units 7, and the four cleaners 10, and are opposite to each other in the right-left direction while defining a gap therebetween in the right-left direction for the spaces 12.

As shown in FIG. 2, each side plate 22 is formed with a flange 26 protruding outward from an outer surface thereof with respect to the right-left direction. The flange 26 is located at a position slightly lower than an upper edge of the side plate 22 and extending along the entire length of the side plate 22 in the front-rear direction. A pair of grooves 27 extending in the front-rear direction is formed one in either the inner right or left surface of the main casing 2 (only one of the grooves 27 on the left side is shown in FIG. 2). The flange 26 is inserted into (engaged with) the corresponding groove 27 from the front side. With this configuration, the drawer unit 3 (the drawer frame 21) is supported on the main casing 2, and the drawer unit 3 (the drawer frame 21) can move smoothly between the accommodated position within the main casing 2 and the pulled-out position outside the main casing 2 as the flanges 26 slide along the grooves 27.

The left side plate 22 is formed with four grooves 25 in the upper surface thereof, at positions opposite to the respective spaces 12 in the left-right direction, and four operation members 30 are disposed in the respective grooves 25. Each operation member 30 has a support shaft 31 and an arm 32 pivotable about the support shaft 31.

The support shaft 31 is disposed in a rear section of the groove 25 and protrudes upward from the left side plate 22. An upper end of the support shaft 31 is substantially in flush with sections of the upper surface of the left side plate 22 other than where the grooves 25 are formed.

Figure 5:
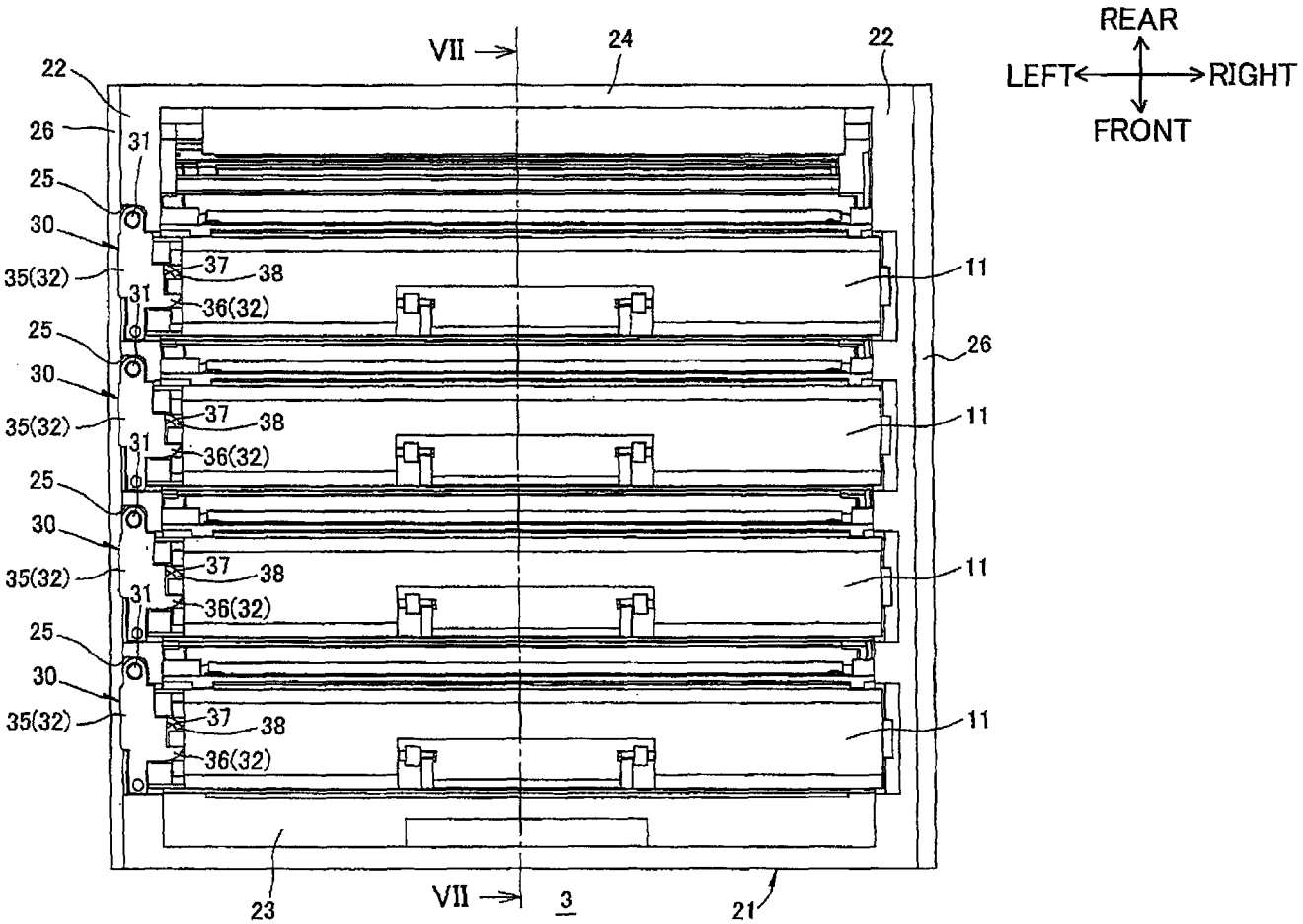
FIG. 5 is a plan view of the drawer unit.

As shown in FIG. 5, the arm 32 integrally includes a main part 35 and an abutting part 36. An upper surface of the arm 32 is substantially in flush with the sections of the upper surface of the left side plate 22 other than where the grooves 25 are formed.

The main part 35 is formed in a rod shape, and the support shaft 31 is inserted through a rear end section of the main part 35.

The abutting part 36 is formed substantially in a semicircular shape and protrudes inward (rightward) from a substantial front-rear center of the main part 35 when the main part 35 is positioned to extend along the front-rear direction. A reception groove 37 substantially fan shaped in a plan view is formed at a right rear corner in the upper surface of the abutting part 36.

Figure 11A:
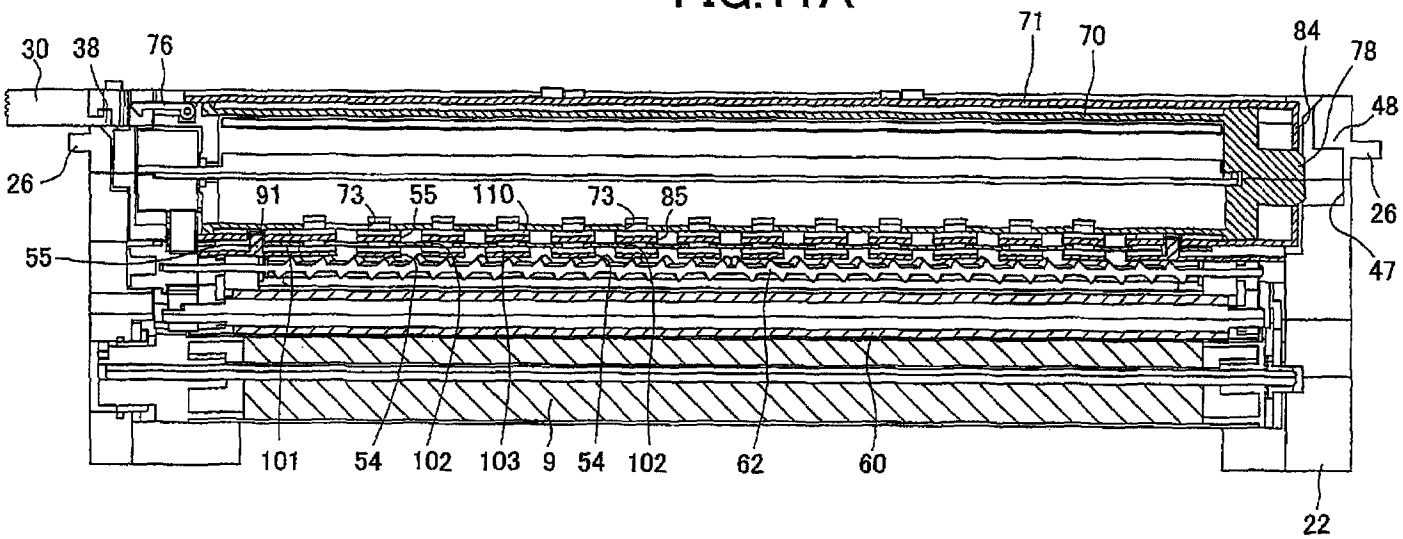
FIG. 11A is a cross-sectional front view of the toner cartridge and the drawer unit taken along a line XI-XI of FIG. 7, with closed inner openings.

The abutting part 36 is formed with an engaging part 38 that projects upward from the bottom surface of the reception groove 37 to a position lower than the upper surface of the main part 35 and that extends along the circumference of the abutting part 36 (see FIG. 11A also).

Figure 10A:
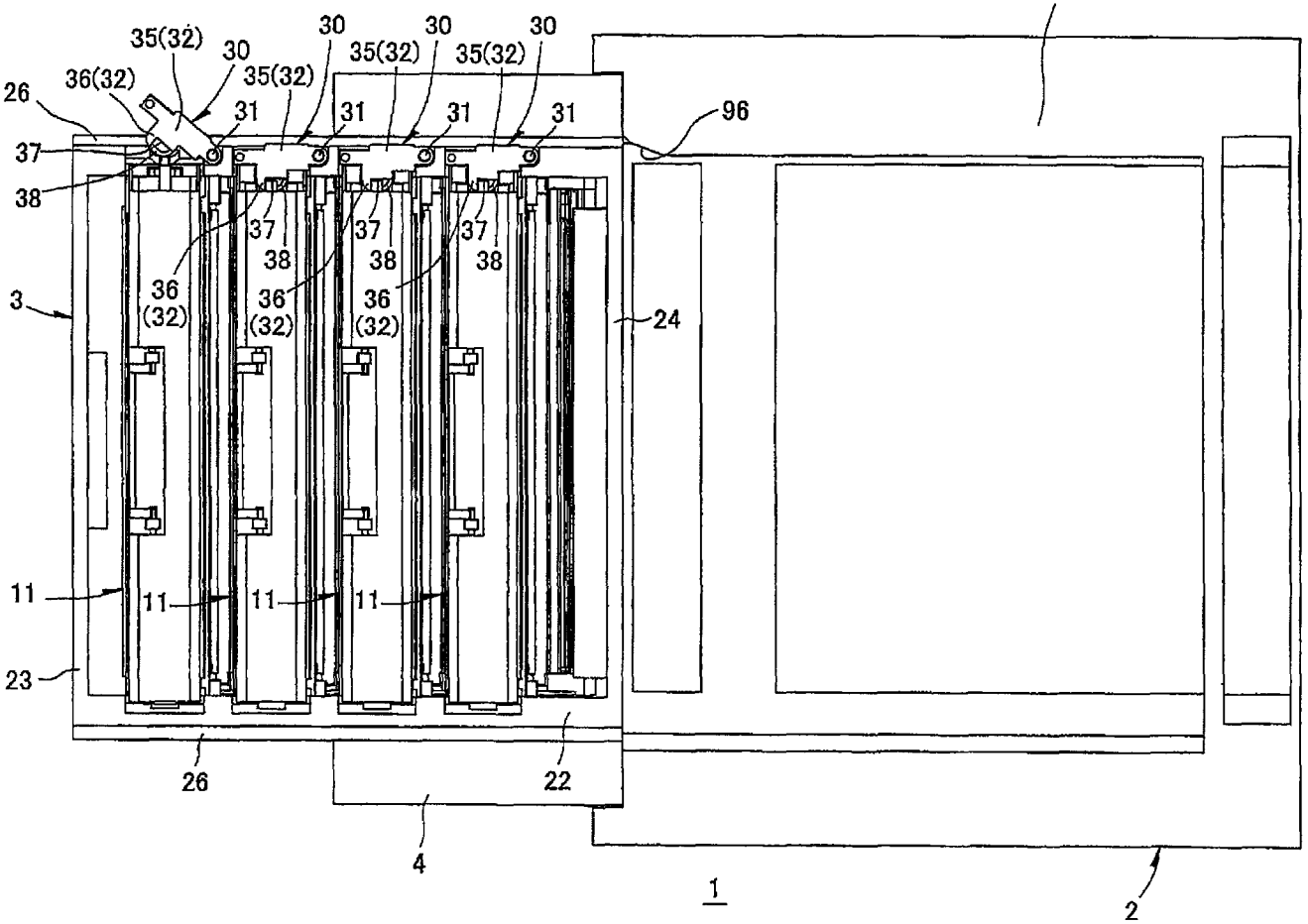
FIG. 10A is a cross-sectional top view of the laser printer with the drawer unit located at the pulled-out position and three operation members from the rear side located at respective pressing positions.

Each operation member 30 (the main part 35) is movable between a pressing position and a separate position by pivoting about the support shaft 31. In FIG. 10A, the three operation members 30 on the rear side are located at the respective pressing positions, and the first operation member 30 from the front side is located at the separate position. As shown in FIG. 10A, when the operation member 30 is at the pressing position, the main part 35 extends along the front-rear direction. When the operation member 30 is located at the separate position, on the other hand, a front end of the main part 35 is separate from the left side plate 22 toward the left.

Figure 6:
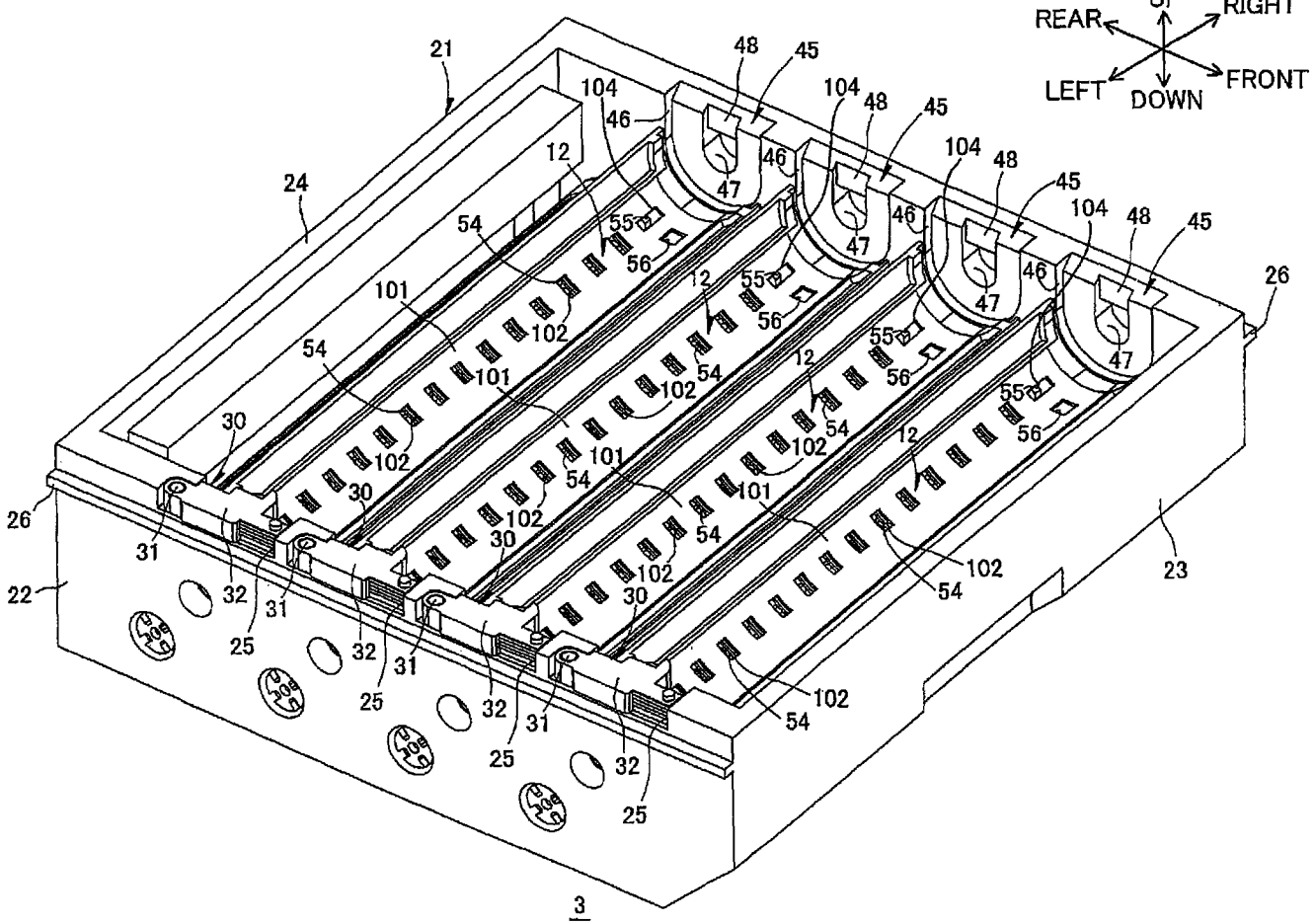
FIG. 6 is a perspective view of the drawer unit from a point diagonally above and leftward thereof, with all toner cartridges removed.

When the operation member 30 is at the pressing position, the abutting part 36 is located in the space 12 as shown in FIG. 6 in a plan view. When the operation member 30 is at the separate position, on the other hand, the abutting part 36 is outside the space 12 in a plan view.

As shown in FIG. 6, the right side plate 22 is formed with four receiving parts 45 in one-to-one correspondence with the spaces 12. Each receiving part 45 is a groove formed in the inner surface of the right side plate 22, and includes a first groove 46, a second groove 47, and a restricting section 48.

The first groove 46 has substantially the same shape as the toner cartridge 11 (FIG. 1) in a side view. The first groove 46 is formed substantially in a shape of letter U at a corner between the upper edge and the inner surface of the right side plate 22.

The second groove 47 is formed in the first groove 46 to a greater depth than the first groove 46 in the right-left direction.

The restricting section 48 is formed to cover about a right half section of an upper part of the second groove 47.

Figure 7:
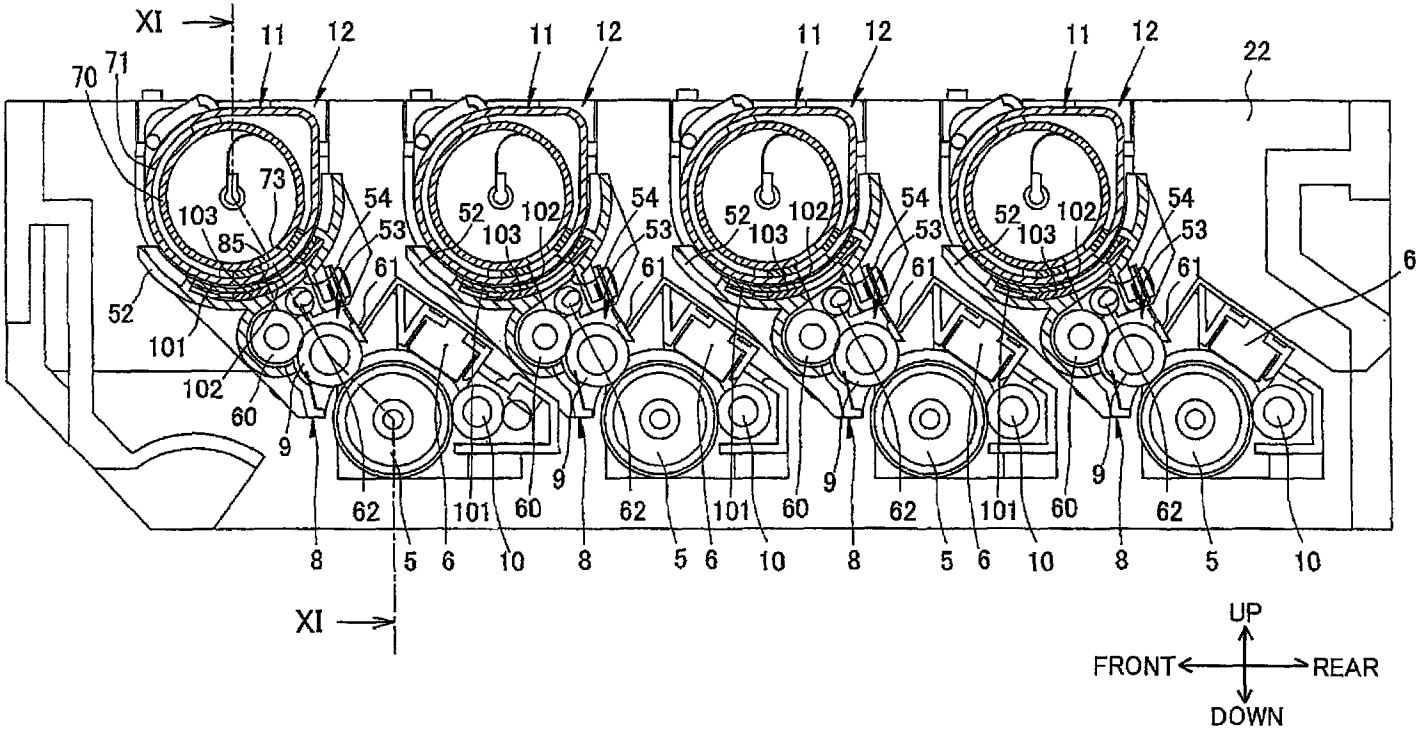
FIG. 7 is a cross-sectional right side view of the drawer unit taken along a line VII-VII of FIG. 5.

As shown in FIG. 7, the four developing frames 8 are aligned at regular intervals in the front-rear direction and spanning between the side plates 22. The spaces 12 are partitioned by the developing frames 8.

Each developing frame 8 is formed with a developing chamber 53 for accommodating the developing roller 9. The developing chamber 53 is open on a photosensitive drum 5 side, and the developing roller 9 is disposed at this open end of the developing chamber 53.

Each developing frame 8 is provided with a plate-shaped partitioning wall 52 located between the developing chamber 53 and the space 12. The partitioning wall 52 protrudes in an arc shape toward the developing chamber 53, and partitions the interior of the developing frame 8 into the developing chamber 53 and the space 12 located higher than the developing chamber 53.

As shown in FIG. 6, a plurality of developing openings 54 is formed at a center of the partitioning wall 52 in a circumferential direction thereof, and is aligned at constant intervals in the right-left direction. The developing chamber 53 is fluidly connected to the space 12 through the developing openings 54.

The developing frame 8 is also provided with a plate-shaped developing shutter 101 that is disposed on and slidable along the partitioning wall 52 in the right-left direction. The developing shutter 101 extends in the right-left direction and is curved to follow the arc shape of the partitioning wall 52.

Figure 11B:
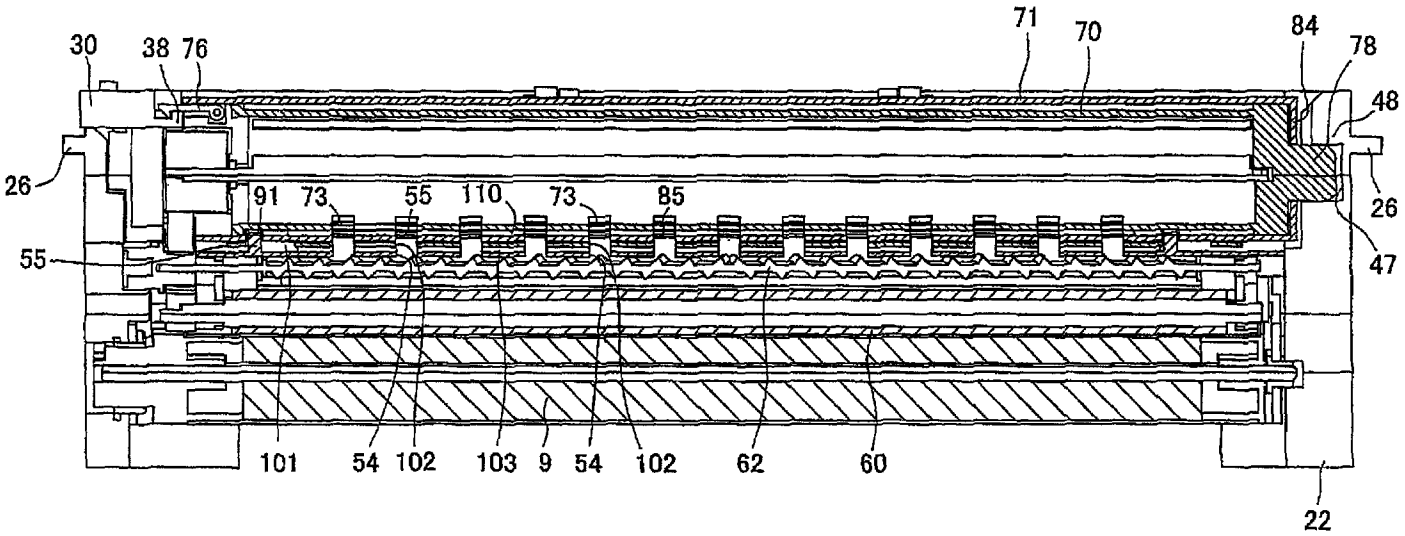
FIG. 11B is a cross-sectional front view of the toner cartridge and the drawer unit taken along the line XI-XI of FIG. 7, with open inner openings.

The developing shutter 101 is formed with a plurality of shutter openings 102 at the same positions as the developing openings 54 with respect to the circumferential direction of the partitioning wall 52. Thus, the developing shutter 101 can selectively open and close the developing openings 54 by sliding in the right-left direction along the partitioning wall 52. That is, when the developing shutter 101 is at an opening position where the shutter openings 102 overlap the developing openings 54 as shown in FIG. 11B, the developing openings 54 are open. When the developing shutter 101 is at a closing position where the shutter openings 102 confront an inner surface of the partitioning wall 52 as shown in FIG. 11A, on the other hand, the developing openings 54 are closed.

As shown in FIG. 7, a developing seal 103 is attached on the upper surface of the partitioning wall 52 confronting the developing shutter 101. The developing seal 103 is formed with openings at positions opposite to the respective developing openings 54.

As shown in FIG. 6, a fixing protrusion (fixing member) 55 is formed at the right end section of the partitioning wall 52. Although not shown in the drawings, another fixing protrusion 55 is also formed at the left end section of the partitioning wall 52.

The fixing protrusions 55 are formed opposite to the developing openings 54 in the right-left direction, and protrude substantially upward from the partitioning wall 52. The developing shutter 101 is formed with two insertion holes 104 (only one of which is shown in FIG. 6) that the fixing protrusions 55 penetrate through. The insertion hole 104 is formed in a rectangular shape with a longer dimension in the right-left direction. The developing shutter 101 is also formed with two engaging ports 56 (only one of which is shown in FIG. 6) at positions spaced apart from the respective insertion holes 104 in the front-rear direction.

As shown in FIG. 7, the developing roller 9, a supply roller 60, a thickness regulation blade 61, and an auger 62 are disposed within the developing chamber 53.

The developing roller 9 extends in the right-left direction and rotatably supported to the developing frame 8. A lower rear section of a circumferential surface of the developing roller 9 is exposed outside the developing frame 8. When the developing frame 8 is mounted on the drawer unit 3 (FIG. 1), this exposed section of the developing roller 9 contacts the photosensitive drum 5.

The supply roller 60 extends in the right-left direction and rotatably supported to the developing frame 8. The supply roller 60 is located diagonally frontward and downward of the developing openings 54 and pressingly contacts the developing roller 9 from the upper front side.

The thickness regulation blade 61 has a base end fixed to a rear section of the developing frame 8 and a tip end pressingly contacting the circumferential surface of the developing roller 9.

The auger 62 is located below the developing openings 54, extends in the right-left direction, and is rotatably supported to the developing frame 8.

Figure 8:
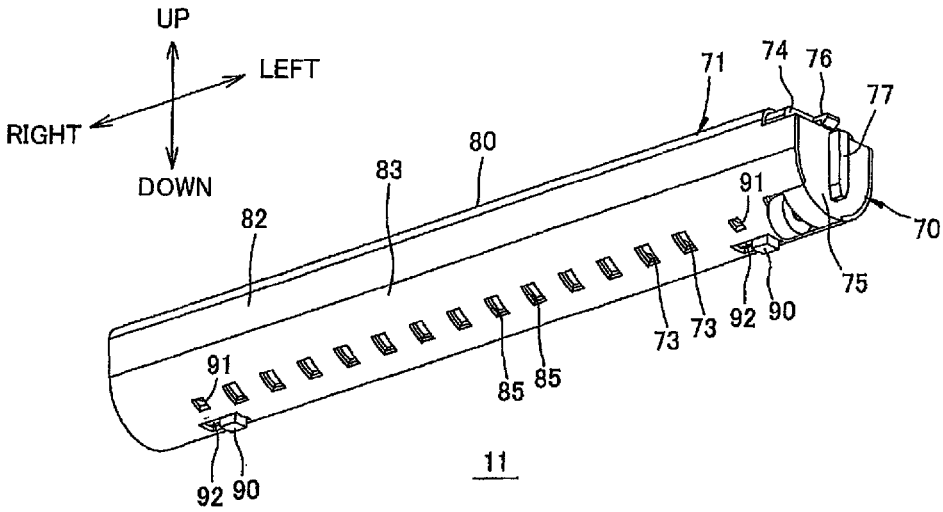
FIG. 8 is a perspective view of a toner cartridge of the laser printer from a point diagonally down and leftward thereof.
Figure 9:
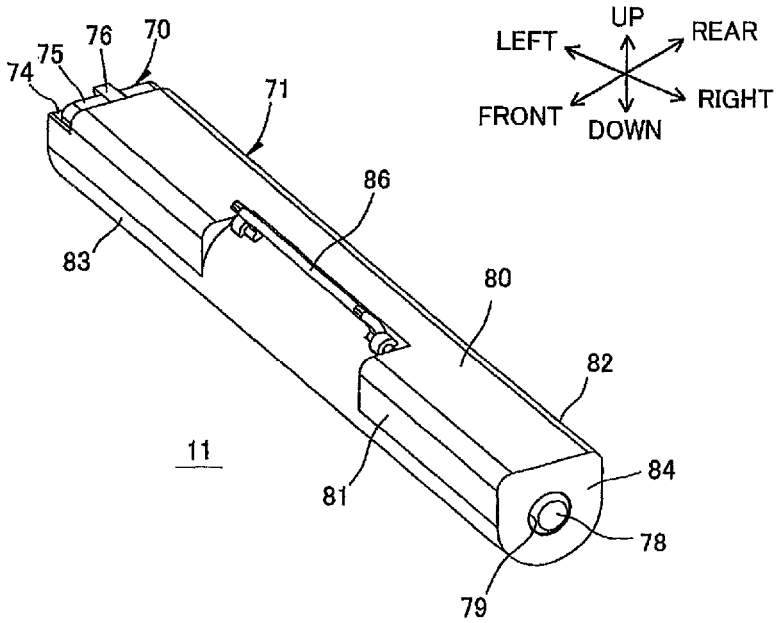
FIG. 9 is a perspective view of the toner cartridge from a point diagonally above and rightward thereof.

As shown in FIGS. 7 to 9, the toner cartridge 11 includes an inner casing 70 for accommodating toner and an outer casing 71 serving as a shutter for accommodating the inner casing 70. The inner casing 70 is movable in the right-left direction within the outer casing 71, and an upper left section of the inner casing 70 is exposed to the outside of the outer casing 71.

The inner casing 70 is formed in a hollow cylindrical shape elongated in the left-right direction in a plan view, and is formed with a plurality of rectangular-shaped inner openings 73 in a circumferential surface thereof, as shown in FIG. 8. The inner openings 73 are formed at positions opposite to the shutter openings 102 of the developing shutter 101 when the toner cartridge 11 is accommodated in the space 12.

As shown in FIG. 9, the inner casing 70 is also formed with a recess 74 at an upper left corner thereof, and the recess 74 penetrates through the inner casing 70 in the front-rear direction. In other words, the left section of the upper surface of the inner casing 70 is formed lower than the remaining section thereof.

An engaging part 76 is provided within the recess 74. The engaging part 76 protrudes leftward from a surface of the inner casing 70 located rightward of the recess 74 (a surface facing the recess 74) and bends downward into a hook as shown in FIG. 11B. The left end of the engaging part 76 is located rightward of the left surface of the inner casing 70.

As shown in FIG. 6, the inner casing 70 is also formed with a column-shaped stopper 78 that protrudes rightward from a right end of the inner casing 70. The stopper 78 is inserted into an insertion hole 79 formed in a right wall 84 of the outer casing 71.

As shown in FIG. 8, the inner casing 70 is formed with engaging protrusions 90 on a lower surface thereof. The engaging protrusions 90 are formed substantially in a rectangular shape at positions opposite to the engaging ports 56 (FIG. 6) of the developing frame 8 when the toner cartridge 11 is mounted on the drawer unit 3. The engaging protrusions 90 have substantially the same size as the engaging ports 56.

The outer casing 71 includes an upper wall 80 extending in the right-left direction, a front wall 81 extending downward from a front end of the upper wall 80, a rear wall 82 extending downward from a rear end of the upper wall 80, a bottom wall 83 connecting between lower ends of the front wall 81 and the rear wall 82 and protruding downward in an arc shape, the right wall 84 spanning between right ends of the front, rear, and bottom walls 81, 82, and 83, and a left wall 75 spanning between left ends of the front, rear, and bottom walls 81, 82, and 83.

As shown in FIG. 8, the bottom wall 83 is formed with a plurality of outer openings 85 having substantially the same shape as the inner openings 73, at positions opposite to the developing openings 54 of the partitioning wall 52 when the toner cartridge 11 is accommodated in the space 12.

An interval between adjacent outer openings 85 is set greater than a right-left dimension of the outer opening 85, and the inner casing 70 is movable in the right-left direction relative to the outer casing 71 as described later. Thus, when the inner casing 70 is located at a predetermined opening position, the inner openings 73 confront the outer openings 85, so the internal space of the toner cartridge 11 is in fluid communication with the outside of the toner cartridge 11. In other words, the outer casing 71 opens the inner openings 73. Also, when the inner casing 70 is moved from the opening position to a predetermined closing position relative to the outer casing 71 in the right-left direction, then the inner openings 73 confront sections of the outer casing 71 between the outer openings 85 (sections of the outer casing 71 where the outer openings 85 are not formed), so the inner openings 73 are closed by the outer casing 71.

That is, when the inner casing 70 moves in the right-left direction, the outer casing 71 moves relative to the inner casing 70 and selectively opens and closes the inner openings 73. Said differently, moving the inner casing 70 to the opening position opens the outer casing 71, and moving the inner casing 70 to the closing position closes the outer casing 71.

The bottom wall 83 is also formed with rectangular-shaped fixing ports 91 on the right and left sides of the outer openings 85, at positions opposite to the fixing protrusions 55 (FIG. 5) of the developing frame 8 when the toner cartridge 11 is mounted on the drawer unit 3. The fixing ports 91 have substantially the same size as the fixing protrusions 55.

The bottom wall 83 is also formed with two through holes 92 at positions opposite to the engaging protrusions 90 of the inner casing 70. Each through hole 92 is formed in a rectangular shape with a greater right-left dimension than the engaging protrusion 90, which allows the engaging protrusion 90 to move within the through hole 92 when the inner casing 70 moves in the right-left direction relative to the outer casing 71.

The left wall 75 is formed with a protrusion 77 extending substantially in the up-down direction. Although not shown in the drawings, the left side plate 22 (FIG. 2) of the drawer unit 3 is formed with a guide groove extending substantially in the up-down direction for receiving the protrusion 77. The toner cartridge 11 moves along the guide groove when mounted onto or detached from the drawer unit 3.

As shown in FIG. 9, the upper wall 80 is formed with a handle 86 at a left-right center thereof. The handle 86 is formed pivotable with respect to the outer casing 71.

As shown in FIG. 11A, a toner seal 110 is attached on an inner circumferential surface of the outer casing 71 to encompass peripheries of the outer openings 85.

When the drawer unit 3 is located at the pulled-out position outside the main casing 2 as shown in FIG. 2, the spaces 12 of the drawer frame 21 are exposed upward. The toner cartridge 11 is accommodated into or removed from the corresponding space 12 from the upper side. When no toner cartridge 11 is accommodated in the space 12, the operation member 30 is located at the separate position, as the first operation member 30 from the front side shown in FIG. 10A.

When the toner cartridge 11 is completely detached from the drawer unit 3, the inner casing 70 is located at the closing position, and thus the inner openings 73 are closed.

When mounting the toner cartridge 11 onto the drawer unit 3, the toner cartridge 11 is first placed above the space 12 and then lowered into the space 12. At this time, the protrusion 77 of the toner cartridge 11 is guided downward by the guide groove (not shown) formed in the left side plate 22 of the drawer unit 3.

When the toner cartridge 11 is accommodated into the space 12, the engaging protrusions 90 of the inner casing 70 of the toner cartridge 11 shown in FIG. 8 engage the engaging ports 56 of the developing frame 8 (the developing shutter 101) shown in FIG. 6, and the fixing protrusions 55 of the developing frame 8 (the partitioning wall 52) shown in FIG. 6 engage the fixing ports 91 of the outer casing 71 shown in FIG. 8.

In this condition, the stopper 78 of the toner cartridge 11 shown in FIG. 9 confronts the second groove 47 of the receiving part 45 of the right side plate 22 shown in FIG. 6 with respect to the right-left direction, as shown in FIG. 11A.

Then, the operation member 30 is pivoted counterclockwise in a plan view from the separate position toward the pressing position such that the front end of the main part 35 moves rightward.

In the middle of this pivot movement, the abutting part 36 of the operation member 30 comes into abutment with the exposed upper left section of the inner casing 70. When the operation member 30 is further pivoted, the operation member 30 presses the inner casing 70 rightward with the abutting part 36. At this time, the fixing protrusions 55 of the developing frame 8 are in engagement with the fixing ports 91 of the outer casing 71, so the position of the outer casing 71 relative to the developing frame 8 is fixed. Also, the engaging protrusions 90 of the inner casing 70 are in engagement with the engaging ports 56 of the developing shutter 101 at this time. Thus, when the inner casing 70 is pressed rightward, the outer casing 71 does not move, but the inner casing 70 and the developing shutter 101 move rightward as an integral unit.

As a result, as shown in FIG. 11B, the stopper 78 projects to a position rightward of the right wall 84 of the outer casing 71 and enters the second groove 47 of the right side plate 22. Because the restricting section 48 is disposed in the upper section of the second groove 47, the stopper 78 received into the second groove 47 cannot move upward.

When the operation member 30 reaches the pressing position at which the front end of the main part 35 is most proximate to the left side plate 22, then the further movement of the operation member 30 (the main part 35) is prevented. In this condition, the abutting part 36 remains pressing the inner casing 70.

As a result, the inner openings 73 confront the outer openings 85, and the shutter openings 102 confront the developing openings 54, so the inner space of the inner casing 70 is fluidly connected to the developing chamber 53 through the inner openings 73, the outer openings 85, the shutter openings 102, and the developing openings 54. Also, the engaging part 38 of the abutting part 36 engages with the engaging part 76 of the toner cartridge 11 (the inner casing 70) as shown in FIG. 11B.

When the operation member 30 is pivoted clockwise in a plan view from the pressing position to the separate position such that the front end of the main part 35 moves leftward, then the engaging part 38 applies leftward force to the engaging part 76, so the inner casing 70 and the developing shutter 101 move leftward as an integral unit to the respective closing positions. As a result, the fluid communication between the inner space of the inner casing 70 and the developing chamber 53 is shielded by the outer casing 71 and the developing shutter 101.

Figure 10B:
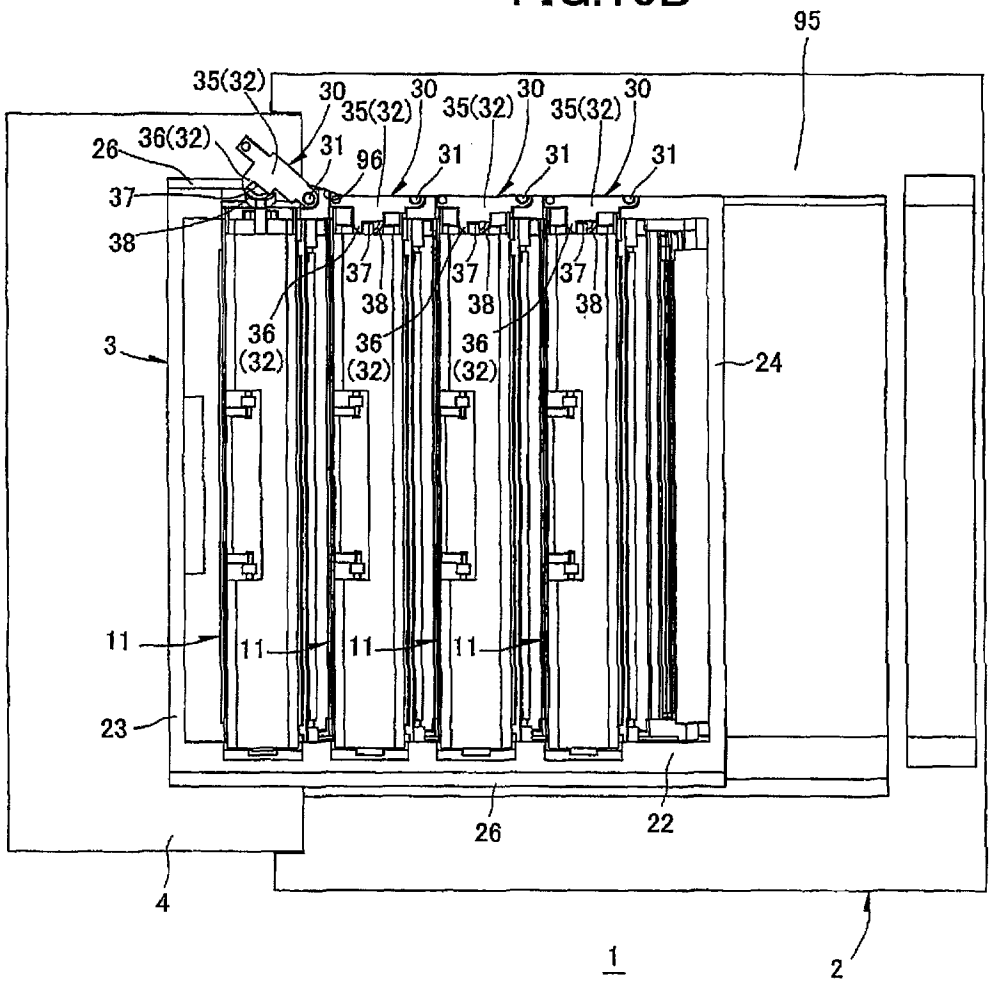
FIG. 10B is a cross-sectional top view of the laser printer with the drawer unit at a position between the pulled-out position and an accommodated position.
Figure 10C:
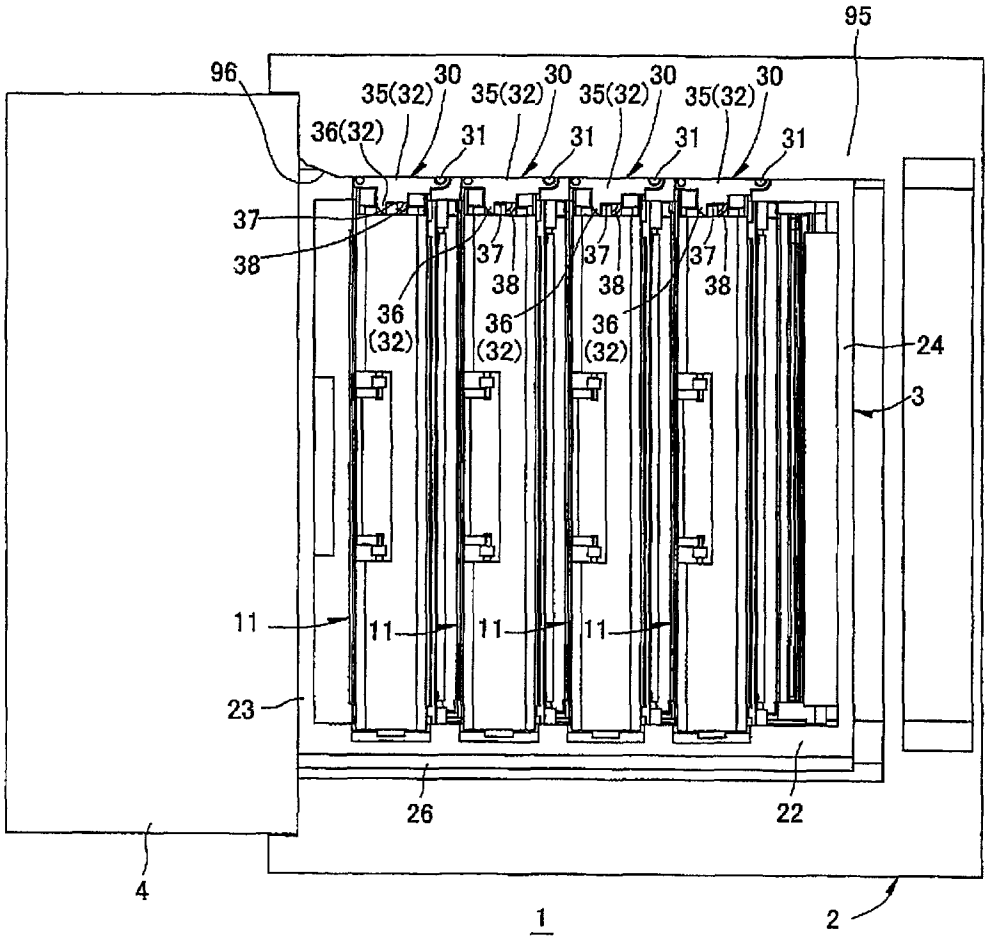
FIG. 10C is a cross-sectional top view of the laser printer with the drawer unit located at the accommodated position and four operation members all located at respective pressing positions.

As shown in FIGS. 10A to 10C, the above-described operation on the operation member 30 for opening the outer casing 71 (for moving the inner casing 70 to the opening position) may be achieved in association with the insertion of the drawer unit 3 into the main casing 2. Details will be described next.

As shown in FIG. 10A, a left side plate 95 of the main casing 2 is formed with a sloped surface (abutting part) 96, sloping rightward toward the rear.

When the drawer unit 3 is moved rearward from the pulled-out position shown in FIG. 10A, then the main part 35 of the operation member 30 located at the separate position comes into abutment with the sloped surface 96 from the front side as shown in FIG. 10B.

When the drawer unit 3 is moved further rearward thereafter, the main part 35 is pressed by the sloped surface 96 and pivoted counterclockwise in a plan view to the pressing position. As a result, the abutting part 36 presses the inner casing 70 of the toner cartridge 11 rightward into the opening position.

If two or more operation members 30 are located at the separate positions, then all of these operation members 30 are sequentially brought into the pressing positions in the same manner.

When the drawer unit 3 reaches the accommodated position within the main casing 2 as shown in FIG. 10C, then all of the four operation members 30 are located at the pressing positions, so all of the four toner cartridges 11 are open (the inner casings 70 of the toner cartridges 11 are all in the opening positions).

As described above, in this embodiment, the drawer unit 3 is provided movable between the accommodated position within the main casing 2 and the pulled-out position outside the main casing 2. The plurality of photosensitive drums 5 are aligned at fixed intervals on the drawer unit 3. The drawer unit 3 is provided with the four developing units 7 in one-to-one correspondence with the photosensitive drums 5, and the toner cartridges 11 are mounted on the drawer unit 3.

The toner cartridges 11 correspond to the developing frames 8 and are detachable from the drawer unit 3. The inner casing 70 of each toner cartridge 11 is formed with the inner openings 73 for supplying toner accommodated in the toner cartridge 11 to the developing unit 7. The toner cartridge 11 includes the outer casing 71 for selectively opening and closing the inner openings 73.

The drawer unit 3 is provided with the four operation members 30 in correspondence with the toner cartridges 11 (the spaces 12). When the operation member 30 is moved in a direction (rightward) parallel to an axial direction of the photosensitive drum 5, then the inner casing 70 is pressed by the operation member 30 to move relative to the outer casing 71 in a moving direction of the operation member 30, thereby opening the inner openings 73. That is, when opening the inner openings 73, the drawer unit 3 is applied with a force in the moving direction of the operation member 30 parallel to the axial direction of the photosensitive drum 5. Thus, even when the outer casing 71 is opened while the drawer unit 3 is at the pulled-out position, there is no danger that the color printer 1 overturns, because downward force is not applied to the drawer unit 3.

Also, because the operation member 30 is provided to the drawer frame 21, the inner casing 70 of the toner cartridge 11 is not moved when the toner cartridge 11 is detached from the drawer frame 21. Thus, it is possible to prevent the inner casing 70 from being accidentally moved to the opening position when the toner cartridge 11 is detached from the drawer frame 21.

Providing the operation member 30 to the toner cartridge 11 reduces the operability of the operation member 30 when the toner cartridge 11 is attached to the drawer frame 21. However, because the operation member 30 is provided to the drawer frame 21 in this embodiment, the operability of the operation member 30 is improved.

As the drawer unit 3 is moved from the pulled-out position toward the accommodated position, the operation member 30 moves to press the inner casing 70. Thus, in association with the movement of the drawer unit 3 toward the accommodated position, the inner casing 70 moves relative to the outer casing 71 in the moving direction of the operation member 30, thereby opening the inner openings 73. Thus, even if the drawer unit 3 is moved from the pulled-out position to the accommodated position when the outer casing 71 is closing the inner openings 73, the operation member 30 reliably opens the outer casing 71 (the inner openings 73). Thus, it is possible to prevent the outer casing 71 from keeping closing the inner openings 73 when the drawer unit 3 is at the accommodated position.

The operation member 30 includes the support shaft 31 and the arm 32. The support shaft 31 extends in a direction perpendicular to both the axial direction of the photosensitive drum 5 and a moving direction of the drawer unit 3. The arm 32 extends from the support shaft 31 toward the pulled-out position and pivotable about the support shaft 31 between the pressing position and the separate position.

When the drawer unit 3 is moved from the pulled-out position to the accommodated position, the sloped surface 96 of the main casing 2 abuts and moves the arm 32 from the separate position to the pressing position. Thus, it is possible to move the arm 32 to the pressing position in association with the movement of the drawer unit 3 from the pulled-out position to the accommodated position.

The developing unit 7 is formed with the fixing protrusions 55 for fixing the outer casing 71 in place when the toner cartridge 11 is mounted on the drawer unit 3. Thus, when the operation member 30 moves the inner casing 70 in the right-left direction when the toner cartridge 11 is on the drawer unit 3, the inner casing 70 moves relative to the outer casing 71 in the right-left direction.

The stopper 78 is formed on the right end of the inner casing 70 for preventing the toner cartridge 11 from being detached from the drawer unit 3 when the inner openings 73 are open. Thus, it is possible to reliably prevent the toner cartridge 11 from being detached from the drawer unit 3 with the inner openings 73 being open. Thus, it is possible to prevent toner leakage through the inner openings 73 of the inner casing 70 when the toner cartridge 11 is detached from the drawer unit 3.

The inner casing 70 moves rightward to open the inner openings 73 when pressed by the operation member 30, and the drawer unit 3 is formed with the receiving part 45 (the second groove 47) into which the stopper 78 is inserted when the inner casing 70 is moved rightward. The up-down movement of the stopper 78 is prevented when the stopper 78 is in the receiving part 45. The stopper 78 is inserted into the second groove 47 in a condition that the inner openings 73 are open, and detachment of the toner cartridge 11 from the drawer unit 3 is reliably prevented.

While the invention has been described in detail with reference to the embodiment thereof, it would be apparent to those skilled in the art that various changes and modifications may be made therein without departing from the spirit of the invention.

For example, an urging member may be provided to the toner cartridge 11 or the drawer unit 3 for constantly urging the operation member 30 toward the separate position. In this case, when the drawer unit 3 is pulled outside the main casing 2 and when the operation member 30 separates from the left side plate 95 of the main casing 2, then the operation member 30 is moved to the separate position by urging force of the urging member.

More specifically, as described above, the operation member 30 is formed with the engaging part 38, and the inner casing 70 is formed with the engaging part 76 that engages with the engaging part 38 when the toner cartridge 11 is on the drawer unit 3. Thus, when, the drawer unit 3 is moved toward the pulled-out position and when the sloped surface 96 separates from the arm 32 of the operation member 30, then the urging member moves the arm 32 toward the separate position.

Because the engaging part 38 is in engagement with the engaging part 76, the inner casing 70 moves leftward relative to the outer casing 71 as the arm 32 moves toward the separate position, thereby closing the inner openings 73.

In the above-described embodiment, the main part 35 of the operation member 30 abuts and moves the inner casing 70 of the toner cartridge 11 while the outer casing 71 is fixed in place. However, it is possible to configure such that the main part 35 abuts and moves the outer casing 71 while the inner casing 70 is fixed in place.

What is claimed is:

1. An image forming device comprising:

a main casing;

a support member movable relative to the main casing between an accommodated position within the main casing and a pulled-out position outside the main casing;

a plurality of photosensitive drums supported on the support member and aligned in a line at intervals;

a plurality of developing units corresponding to the plurality of photosensitive drums and supported on the support member;

a plurality of toner cartridges corresponding to the plurality of developing units and detachably mounted on the support member, wherein each of the toner cartridges includes a casing formed with an opening for supplying toner accommodated in the casing to the corresponding one of the developing units and a shutter movable relative to the casing to selectively open and close the opening; and a plurality of operation members corresponding to the plurality of toner cartridges and supported on the support member, wherein each of the operation members is operated in a first direction substantially parallel to an axial direction of the photosensitive drums to press one of the casing and the shutter, thereby moving the shutter relative to the casing in the first direction to open the opening.

2. The image forming device according to claim 1, wherein each of the operation members presses the one of the casing and the shutter as the support member moves toward the accommodated position.

3. The image forming device according to claim 2, wherein:

the support member is movable between the accommodated position and the pulled-out position in a second direction perpendicular to the axial direction of the photosensitive drums;

each of the operation members includes a shaft extending in a third direction perpendicular to both the second direction and the axial direction of the photosensitive drums and an arm extending from the shaft toward the pulled-out position and pivotable about the shaft between a pressing position at which the arm presses the one of the casing and the shutter and a separate position at which the arm is separate from the one of the casing and the shutter; and the main casing includes an abut member that abuts the arm to move the arm from the separate position to the pressing position when the support member is moved from the pulled-out position to the accommodated position.

4. The image forming device according to claim 1, wherein each of the developing units is provided with a fixing member that fixes the shutter of the toner cartridge mounted on the support member in place.

5. The image forming device according to claim 1, wherein the casing has a first end that is nearest the operation member and a second end that is farthest from the operation member and opposite to the first end with respect to the first direction, and the second end is formed with a stopper that prevents the toner cartridge from being detached from the support member with the opening being open.

6. The image forming device according to claim 5, wherein:

each of the operation members presses and moves the casing in the first direction to open the opening;

the support member is formed with a groove; and the stopper is inserted into or removed from the groove in the first direction.

* * * * *